US006535143B1

(12) United States Patent
Miyamoto et al.

(10) Patent No.: US 6,535,143 B1
(45) Date of Patent: Mar. 18, 2003

(54) VEHICLE DETECTION SYSTEM

(75) Inventors: Yukihiko Miyamoto, Tama (JP); Yoshinori Morimoto, Ebina (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 0 days.

(21) Appl. No.: 09/424,262

(22) PCT Filed: Apr. 2, 1999

(86) PCT No.: PCT/JP99/01754

§ 371 (c)(1),
(2), (4) Date: Nov. 19, 1999

(87) PCT Pub. No.: WO99/53462

PCT Pub. Date: Oct. 21, 1999

(30) Foreign Application Priority Data

Apr. 8, 1998 (JP) ..... 10-111347

(51) Int. Cl.[7] ..... G08G 1/01

(52) U.S. Cl. ..... 340/933; 340/928; 340/572.1; 340/5.42; 340/941; 705/13

(58) Field of Search ..... 340/933, 907, 340/941, 928, 561, 552, 572.1–572.9, 905, 5.42, 567; 180/168; 705/13; 701/23, 117, 32; 342/42

(56) References Cited

U.S. PATENT DOCUMENTS 4,325,146 A * 4/1982 Lennington ..... 455/604
5,021,778 A * 6/1991 Walton
5,493,291 A 2/1996 Brüggemann ..... 340/905
5,563,589 A 10/1996 Blaimont et al. ..... 340/933
5,872,525 A * 2/1999 Fukasawa et al. ..... 340/928
6,042,008 A * 3/2000 Ando et al. ..... 235/384
6,140,941 A * 10/2000 Dwyer et al. ..... 340/928
6,141,620 A * 10/2000 Zyburt et al. ..... 701/117
6,263,316 B1 * 7/2001 Khan et al. ..... 705/13
6,342,844 B1 * 1/2002 Rozin ..... 340/933

FOREIGN PATENT DOCUMENTS

| | | |
|---|---|---|
| DE | 198 14 460 A1 | 10/1998 |
| EP | 0 025 816 | 4/1981 |
| JP | 08-220223 | 8/1996 |
| JP | 08-246692 | 9/1996 |

OTHER PUBLICATIONS

Gleissner E: "Von Verkehrsdurchsage Bis Mautstation", Funkschau, vol. 63, No. 7, Mar. 22, 1991, pp. 73–75.

* cited by examiner

*Primary Examiner*—Benjamin C. Lee
(74) *Attorney, Agent, or Firm*—Eric J. Robinson; Robinson Intellectual Property Law Office, P.C.

(57) ABSTRACT

A transponder is selectively mounted on a vehicle. The transponder receives its operation energy through magnetic coupling with the loop coil when the vehicle comes over the loop coil, and transmits predetermined information specific to the vehicle to the vehicle detection circuit. The vehicle detection circuit time divisional performs a supply of the operation energy to the transponder and a reception of the information from the transponder, detects a presence of a vehicle in accordance with a change in the output from the loop coil, and judges from the information received from the transponder whether the detected vehicle is a predetermined vehicle.

8 Claims, 7 Drawing Sheets

VEHICLE DETECTION SYSTEM

BACKGROUND OF THE INVENTION

1. Field of the Invention

The present invention relates to a vehicle detection system for detecting a passage of a vehicle in a non-contact manner, and more particularly to a vehicle detection system capable of discriminately detecting between predetermined specific vehicles and other vehicles and being usable at a parking area or the like.

2. Description of the Related Art

Loop coils buried in the ground have been generally used as a vehicle detection system for managing vehicles incoming and outgoing a parking area. A detection principle of this vehicle detection system is as follows. When a vehicle comes over a loop coil, a parameter of the loop coil changes and this change is detected. For example, when the inductance of a loop coil changes, this inductance change is detected to detect that a vehicle is over the loop coil, and a detection signal is generated.

A conventional vehicle detection system of such a type is shown in FIG. 9. In a conventional vehicle detection system 100, a loop coil 1 buried under an inlet road of a parking area forms a resonance circuit with a capacitor 102 of a self-oscillator 101 which oscillates at the resonance frequency of the resonance circuit. An oscillation output of the self-oscillator 101 is supplied to a frequency discriminator 103 which generates a d.c. voltage corresponding to the oscillation frequency of the self-oscillator 101. A d.c. voltage output from the frequency discriminator 103 is supplied to an A/D converter 104 to convert it into a digital signal. This digital signal is supplied to a controller 105 which compares it with a predetermined threshold value to detect the vehicle.

When a vehicle A comes over the loop coil 1, the inductance of the loop coil 1 lowers because of an eddy current loss by a vehicle body and the oscillation frequency of the self-oscillator 101 shifts to a higher frequency. Therefore, an output of the A/D converter 104 exceeds the threshold value. The controller judges that the vehicle A is over the loop coil 1, and generates a vehicle detection signal. In response to this vehicle detection signal, a ticket vendor 2 and a car gate driver circuit 3 are operated to issue a parking ticket, and when the parking ticket is picked up by the driver, a car gate 4 is opened. In this manner, vehicles incoming and outgoing the parking area are managed. The frequency discriminator 103 is realized by a ratio detector or the like. It can also be realized by a frequency counter. In this case, the A/D converter 104 can be omitted and the count of the frequency counter is directly supplied to the controller 105 to process it.

Charged parking areas include a time charging parking area which charges in accordance with the parked time and a monthly contract charging parking area which contracts on a month unit basis. Most of large time charging parking areas also provide monthly contract charging. Almost all such combined parking areas have a space in the parking area for allowing vehicles of persons in charge of the parking area to be parked.

Such combined parking areas provide services of giving a card to each driver of a specific vehicle such as a contracted vehicle and a vehicle associated with the parking area, and allowing the driver to freely come in and go out of the parking area. Although such a card is used generally by inserting it into a ticket vendor or a fare adjuster, there is a card of a different type whose contents can be read while the driver holds it up in the vehicle. A parking area in/out management system which allows both types of cards has a non-contact card reader. A non-contact card is called a transponder of a non-contact discrimination system which is formed in a card shape.

A vehicle management system of a parking area using both a vehicle detection system and a non-contact card reader is configured as shown in FIG. 10. FIG. 10 shows the parking area incoming side. As shown in FIG. 10, this system is constituted of a non-contact card reader 107 with a card antenna 106, a vehicle detection system 100A with a loop coil 1A, a ticket vendor 2, a car gate driver 3, and another vehicle detection system 100B with a loop coil 1B, all being connected to a controller 105A and disposed in this order from the upstream side of the inlet road of the parking area. The vehicle detection systems 100A and 100B have the structure same as the vehicle detection system 100 shown in FIG. 9. When the controller 105A detects that a vehicle comes over the loop coil 1A, it operates the ticket vendor 2 and car gate driver 3. After the ticket is issued, a car gate 4 is opened. When the controller 105A detects that the vehicle comes over the loop coil 1B, it operates the car gate driver 3 to close the car gate 4. The parking area outlet side is structured in a similar manner except that the ticket vendor is replaced by a fare adjuster.

However, although it is convenient if such a conventional non-contact card reader is provided in combination with an insertion type card reader, the conventional system is associated with some problems. One problem is that a driver is required to carry a card and hold it up when the vehicle comes in and goes out a parking area. If the driver does not hold the card up inadvertently and the vehicle comes over the loop coil, then the ticket vendor issues a parking ticket. Even in such a case, the parking area is required to be managed so that if the driver holds the card up thereafter toward the card reader, the vehicle is allowed to come in the parking area, and the parking ticked once issued becomes wasteful. Another problem is that an illegal parking cannot be inhibited if a card is transferred to a third party from its owner. Another problem is that if a non-contact vehicle discriminator system which discriminates vehicles from vehicle numbers by using image recognition techniques, is used, the camera installation position is limited and the system is expensive.

Some non-contact card readers utilize radio waves, whereas others utilize magnetic fields.

In the former case, a read performance is deteriorated by rains and snows. In such a case, an antenna cannot be buried in the ground, but it is mounted above the ground. There arises therefore a problem that dust-proof and robbery-proof of an antenna is necessary increasing the cost. If a non-contact card reader utilizes microwaves, it is necessary to mount the antenna at the position where a stable read operation is possible in terms of radio wave transmission characteristics, thus posing a problem of a position limitation. Further, in this case, a transponder cannot be mounted under the vehicle body, but it is mounted on the front side of the vehicle body thus degrading the decorative performance of the vehicle body. Also the non-contact card reader utilizing microwaves is associated with some problems that the transponder requires a battery as its power source and is expensive and that the reader is required to receive the model acceptance as a radio wave equipment.

In the latter case, the non-contact card reader utilizes magnetic coupling or magnetic induction. Therefore, a read performance is not affected by rains and snows, an antenna can be buried in the ground, dust-proof and robbery-proof are not necessary, and a transponder can be mounted conveniently under the vehicle body. The distance between the transponder mounted under the vehicle body and the antenna buried under the ground is approximately a distance between the ground surface and the bottom of the vehicle body, so that a stable and less-variation read performance is possible, and the decorative performance of the vehicle body is not damaged. Further with magnetic coupling or magnetic induction, the transponder is not necessary to use a battery, and the reader is not required to receive the model acceptance as a radio wave equipment. However, in the latter case, the frequency range used by the card reader is several tens kHz to several hundreds kHz. The frequency range used by the vehicle detection system is generally several tens kHz to several hundreds kHz near to the above-described frequency range because the inductance of the loop coil is about several tens $\mu$H to several hundreds $\mu$H. Therefore, there arises an interference problem that the non-contact card reader using magnetic coupling or magnetic induction and the vehicle detection system cannot be used at the same time.

SUMMARY OF THE INVENTION

It is an object of the present invention to provide a vehicle detection system capable of being applied to vehicle management not only for a time charging parking area which charges in accordance with the parked time but also for a combined charging parking area which incorporates both the time charging and monthly contract charging, by providing a non-contact vehicle discriminator system utilizing magnetic coupling or magnetic induction.

According to the first aspect of the vehicle detection system of the invention, a vehicle detection system for detecting an arrival of a vehicle in non-contact with the predetermined vehicle comprising; a first inductive element for functioning as transmitting and receiving means a first vehicle detecting circuit connected to the first inductive element, and a transponder mounted on a predetermined vehicle, storing information which identifies the predetermine vehicle, periodically activated by a magnetic field which the first inductive element generates, periodically transmitting the stored information to the first vehicle detecting circuit via the first inductive element, wherein the first vehicle detecting circuit periodically stimulates the first inductive element to generate the magnetic field, the transponder activated during a stimulating period for the first inductive element transmits the stored information to the first vehicle detecting circuit via the first inductive element during a non-stimulating period for the first inductive element when the transponder mounted vehicle has enter into a specified area arranged the first induct element, and the first vehicle detecting circuit detects the arrival of the predetermined vehicle by using the received information from the transponder.

According to the second aspect of the vehicle detection system of the invention, a vehicle detection system comprises: an inductive element mounted at a predetermined position; a transponder selectively mounted on a vehicle, the transponder storing information indicating the vehicle mounted with the transponder is a predetermined vehicle; and a first vehicle detection circuit for magnetically coupling the inductive element when the vehicle mounted with the transponder enters a predetermined area in front of the inductive element, and receiving the information stored in the transponder to detect that the predetermined vehicle enters the predetermined area.

In the vehicle detection system of this invention, when a vehicle mounted with a transponder enters a predetermined area in front of the inductive element, the transponder and inductive element are magnetically coupled with each other, and the information stored in the transponder is read by the first vehicle detection circuit. In accordance with the read information, it is possible to detect that a predetermined vehicle enters the predetermined area in front of the inductive element.

Since magnetic coupling is used, the transponder can be made compact and can be mounted under the vehicle body so that the decorative performance of the vehicle body is not damaged. Further with magnetic coupling, it is not necessary to receive the model acceptance as a radio wave equipment, and the transponder can be made inexpensive. As compared with a non-contact card reader using microwaves, the transponder is not necessary to use a battery, and is more inexpensive.

Furthermore, since magmatic coupling is utilized, influence by rains and snows is not present. Since the inductive element can be buried in the ground, dust-proof and robbery-proof are not necessary. The transponder can be mounted conveniently under the vehicle body. The distance between the transponder mounted under the vehicle body and the inductive element buried in the ground is approximately a distance between the ground surface and the bottom of the vehicle body, so that a stable and less-variation read performance is possible, and the decorative performance of the vehicle body is not damaged.

In the vehicle detection system, the first vehicle detection circuit may time divisional supply the transponder with an operation energy through magnetic coupling with the transponder, or may perform a supply of an operation energy to the transponder and a reception of information from the transponder, and the inductive element is used for both the supply of the operation energy and the reception of the information. In this case, the transponder is not necessary to use a battery as a power source, and the inductive element can be effectively used in common.

The vehicle detection system may further comprises a second vehicle detection circuit magnetically coupling the inductive element for detecting a presence of a vehicle over the inductive element in accordance a change in an electric parameter of the inductive element to be caused by the vehicle on the inductive element. If the second vehicle detection circuit is provided, it is possible to detect that not only a vehicle mounted with a transponder but also a vehicle without a transponder comes over the inductive element. It is therefore convenient that this vehicle detection system can be used by a combined parking area incorporating both time charging and monthly contract charging.

The second vehicle detection circuit may detect a presence of a vehicle in accordance with a phase of an output signal obtained through magnetic coupling with the inductive element, may detect a change in the electric parameter of the inductive element from a voltage charged in a capacitor and detect a presence of a vehicle in accordance with a phase of the charged voltage, or may detect a presence of a vehicle in accordance with a level of output voltage obtained through magnetic coupling with the inductive element. As above, various detection methods can be selectively used and an application field of this system can be broadened.

DETAILED DESCRIPTION OF THE PREFERRED EMBODIMENTS

An embodiment of a vehicle detection system according to the invention will be described.

Figure 1:
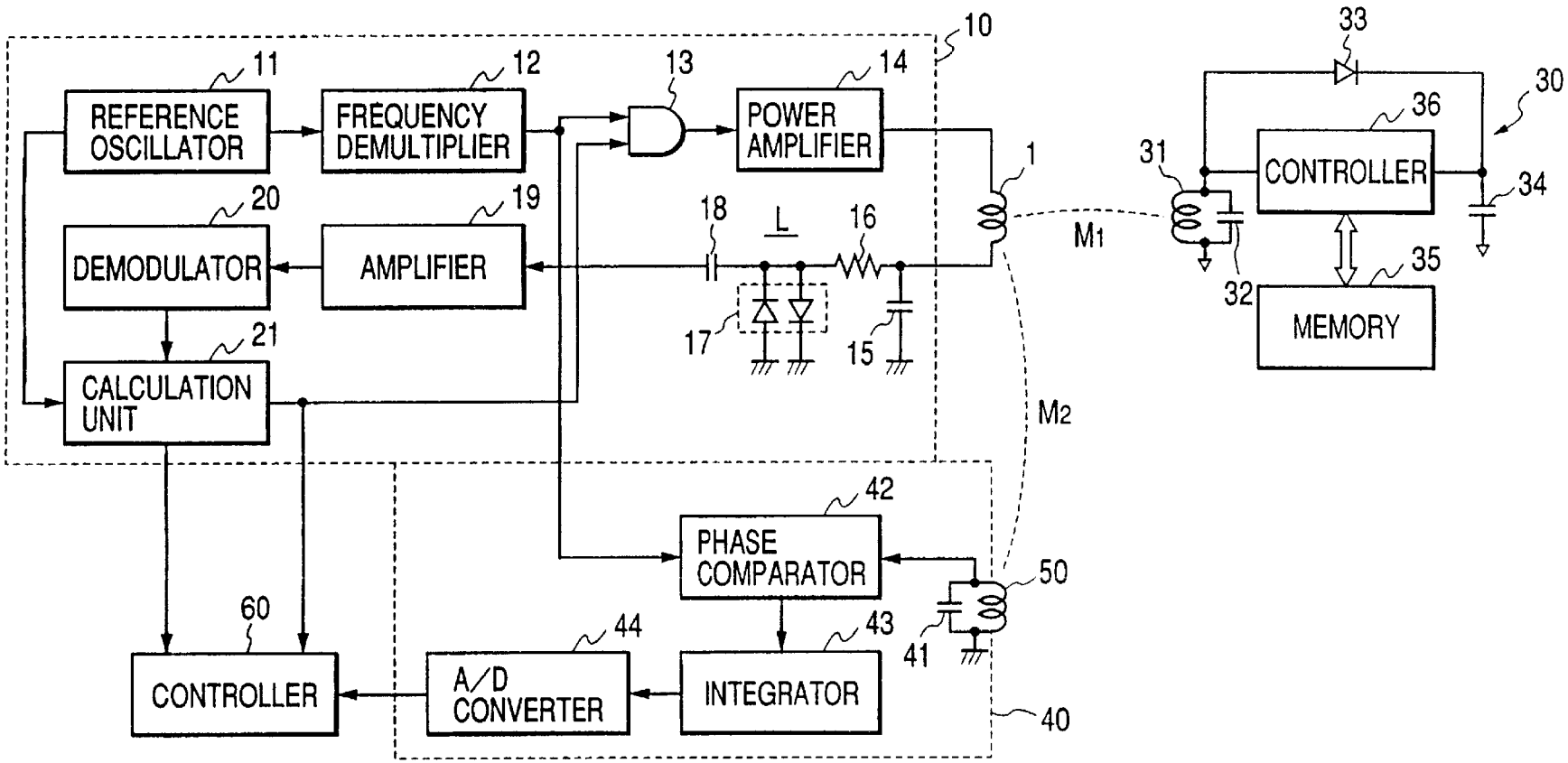
FIG. 1 is a block diagram showing the structure of a vehicle detection system according to an embodiment of the invention.

FIG. 1 is a block diagram showing the structure of a vehicle detection system according to an embodiment of the invention.

Figure 2:
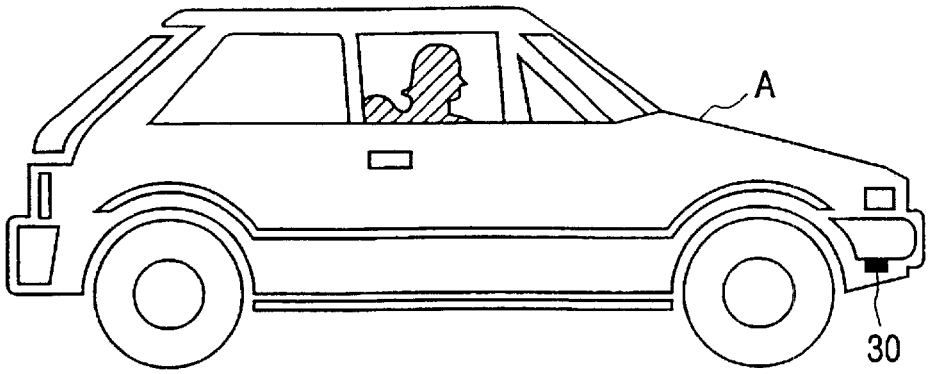
FIG. 2 is a schematic diagram showing an example of a vehicle mounted with a transponder of the vehicle detection system of the embodiment.

The vehicle detection system of the embodiment is constituted of a vehicle detection circuit 10, another vehicle detection circuit 40, and a controller 60. The vehicle detection circuit 10 constitutes a non-contact vehicle discriminator with a loop coil 1 buried, for example, under the parking area inlet road. The vehicle detection circuit 10 detects by using a combination of the loop coil 1 and a transponder 30 that a vehicle such as a monthly contract vehicle comes over the loop coil 1. The other vehicle detection circuit 40 has a coil 50 magnetically coupled to the loop coil 1, and detects from a combination of the loop coil 1 and coil 50 that a vehicle such as a time charging vehicle comes over the loop coil 1. In accordance with vehicle detection signals output from the vehicle detection circuits 10 and 40, the controller 60 drives a ticket vendor and a car gate driver. The transponder 30 is mounted under a bumper of a vehicle A such as a parking area associated vehicle and a monthly contract vehicle, as shown in FIG. 2.

The vehicle detection circuit 10 is constituted of a reference oscillator 11, a frequency divider 12, a calculation unit 21, an AND gate 13, and a power amplifier 14. The frequency demultiplier 12 receives an oscillation output from the reference oscillator 11 and demultiplies the oscillation frequency into a frequency of, e.g., about 100 kHz. The calculation unit 21 receives the oscillation output from the reference oscillator 11 to output a calculation output and also to output a high potential output during a charge period of the transponder 30 (i.e during an activation period for transponder 30). The AND gate 13 outputs the demultiplied output from the frequency demultiplier 21 when both the demultiplied output from the frequency demultiplier 21 and the charge period high potential output from the calculation unit 21, are input. The power amplifier 14 power-amplifies an output of the AND gate. An output of the power amplifier 14 is supplied to the loop coil 1.

The vehicle detection circuit 10 is further constituted of a capacitor 15, a resistor 16, a limiter L, an amplifier 19 and a demodulator 20. The capacitor 15 is serially connected to the loop coil 1 to constitute a serial resonance circuit. The limiter L comprising of the resistor 16 and inversely connected parallel diodes protects the succeeding circuit by limiting the output voltage level of the serial resonance circuit. The amplifier 19 amplifies a discrimination information output, e.g., FSK modulation signal, supplied from the transponder 30 via the limiter L and a capacitor 18. The demodulator 20 demodulates an output of the amplifier 19. The calculation unit 21 also receives a demodulation output from the demodulator 20 and processes the demodulation output such as an error correction process and a decoding process to judge whether the discrimination information indicates that the vehicle is a monthly contract vehicle or a parking area associated vehicle. If the vehicle is a monthly contract vehicle or a parking area associated vehicle, a discrimination signal to such effect is sent to the controller 60.

The transponder 30 is constituted of a coil 31, a capacitor 32, a diode 33, a capacitor 34, a memory 35, and a controller 36. The coil 31 magnetically couples the loop coil 1. The capacitor 32 is connected in parallel to the coil 31 to form a parallel resonance circuit. The diode 33 rectifies current induced in the coil 31. The capacitor 34 is charged by the current rectified by the diode 33 and functions as a power source. The memory 35 stores therein the discrimination information indicating whether the vehicle is a monthly contract vehicle or a parking area associated vehicle. The controller 36 is powered with the charged voltage in the capacitor 34, reads the discrimination information stored in the memory 35, and transmits the discrimination information from the coil 31. As described earlier, the transponder 30 is mounted under the bumper of a monthly contract vehicle or parking area associated vehicle.

The other vehicle detection circuit 40 is constituted of a phase comparator 42, an integrator 43 and an A/D converter 44. The phase comparator 42 compares the phase of a signal output from the frequency demultiplier 12 with the phase of a signal induced in the coil 5. This coil 5 magnetically coupling the loop coil 1 is buried under the road near the loop coil 1 and has the number of turns smaller than that of the loop coil 1. The integrator 43 integrates a phase comparison output from the phase comparator 42. The A/D converter 44 A/D converts the output of the integrator, and supplies the A/D converted vehicle detection signal to the controller 60. A capacitor 41 is connected in parallel to the coil 50 and has a value set so that the phase of voltage induced in the coil 50 when a vehicle comes over the loop coil 1 becomes most suitable for the phase comparison by the phase comparator 42.

The controller 60 receives: the vehicle detection signal from the vehicle detection circuit 10, i.e., from the calculation unit 21; the high potential signal for opening the gate of the AND gate 13; and the vehicle detection signal from the vehicle detection circuit 40. The controller 60 controls: to open the car gate without issuing a parking ticked from the ticket vendor when the vehicle detection signal is supplied from the calculation unit 21; also to open the car gate without issuing a parking ticked from the ticket vendor when the vehicle detection signal is supplied from the calculation unit 21 and when the vehicle detection signal is supplied from the vehicle detection circuit 40; and to operate the ticket vendor and car gate driver to issue a parking ticket and open the car gate after the parking ticket is picked up from the ticket vendor when the vehicle detection signal is not supplied from the calculation unit 21 but the vehicle detection signal is supplied from the vehicle detection circuit 40 during the period while the high potential signal for opening the AND gate is generated.

In the terms used in claims, the loop coil 1 corresponds to an "inductive element", the vehicle detection circuit 10 corresponds to a "first vehicle detection circuit", the transponder 30 corresponds to a "transponder", and the vehicle detection circuit 40 (40A, 40B to be described later) corresponds to a "second vehicle detection circuit".

The operation of the vehicle detection system constructed as above according to the embodiment of the invention will be described.

In the vehicle detection system of the embodiment, the reference oscillator 11 of the vehicle detection circuit 10 oscillates at a predetermined frequency. The oscillation frequency of the reference oscillator 11 is demultiplies by the frequency demultiplier 12 to a frequency of about 100 kHz. The calculation unit 21 received the oscillation output from the reference oscillator 11 supplies a control signal a shown in FIG. 3A having a duty cycle of about ½ and a width of about 50 msec to the AND gate 13. During the high potential period of the control signal a, the gate of the AND gate 13 is opened so that a demultiplied burst output of about 100 kHz is supplied from the frequency demultiplier 12 to the power amplifier 14 which power-amplifies and supplies the amplified power to the serial resonance circuit of the loop coil 1 and capacitor 15.

Upon reception of an output of the power amplifier 14, the loop coil 1 is applied with a high voltage of the output voltage of the power amplifier 14 multiplied by Q of the serial resonance circuit of the loop coil 1 and capacitor 15, so that the loop coil 1 generates a magnetic field (that is to say the loop coil 1 is stimulated to generate a magnetic field). In this case, the level of this high voltage is limited by the limiter L so that the succeeding stage circuit is prevented from being destroyed by the high potential.

For the convenience of description, consider now the case wherein a vehicle A mounted with the transponder 30 under the bumper enters first a predetermined area around the loop coil 1 and then comes over the loop coil 1.

When the vehicle A mounted with the transponder 30 under the bumper enters the predetermined area around the loop coil 1, the loop coil 1 magnetically couples the transponder 30 mounted under the vehicle A. This magnetic coupling is indicated by M1 in FIG. 1. With this magnetic coupling, the coil 31 links with magnetic fluxes generated by the loop coil 1 applied with an amplified output of the power amplifier 14. Therefore, an electromotive force is induced in the coil 31 during the high potential period (50 msec) of the control signal a (refer to FIG. 3A), so that current flows through the parallel resonance circuit of the coil 31 and capacitor 32. This current is rectified by the diode 33 and charges the capacitor 34. Therefore, transponder 30 is activated during this period and a rectified voltage b shown in FIG. 3B appears across the capacitor 34 which therefore functions as a power source of the transponder 30. The transponder 30 is activated during this period and therefore it is unnecessary to have a power source such as a battery.

Upon application of the charged voltage across the capacitor 34, the controller 36 reads the discrimination information from the memory 35. The read discrimination information FSK-modulates a carrier of about 100 kHz during a period shown in FIG. 3C, and is transmitted from the controller 36 via the parallel resonance circuit of the coil 36 and capacitor 32.

After the high potential period (50 msec) of the control signal a, the calculation unit 21 outputs a low level signal during a next period (50 msec). During the low level period of the control signal a, the gate of the AND gate 13 is closed so that no input signal is supplied to the power amplifier 14. The output terminal of the power amplifier 14 becomes therefore in a grounded state and the loop coil 1 and capacitor 15 form a parallel resonance circuit relative to the carrier and function as an antenna for receiving a signal transmitted from the transponder 30. This period is a non-stimulated period for the loop coil 1.

Figure 3:
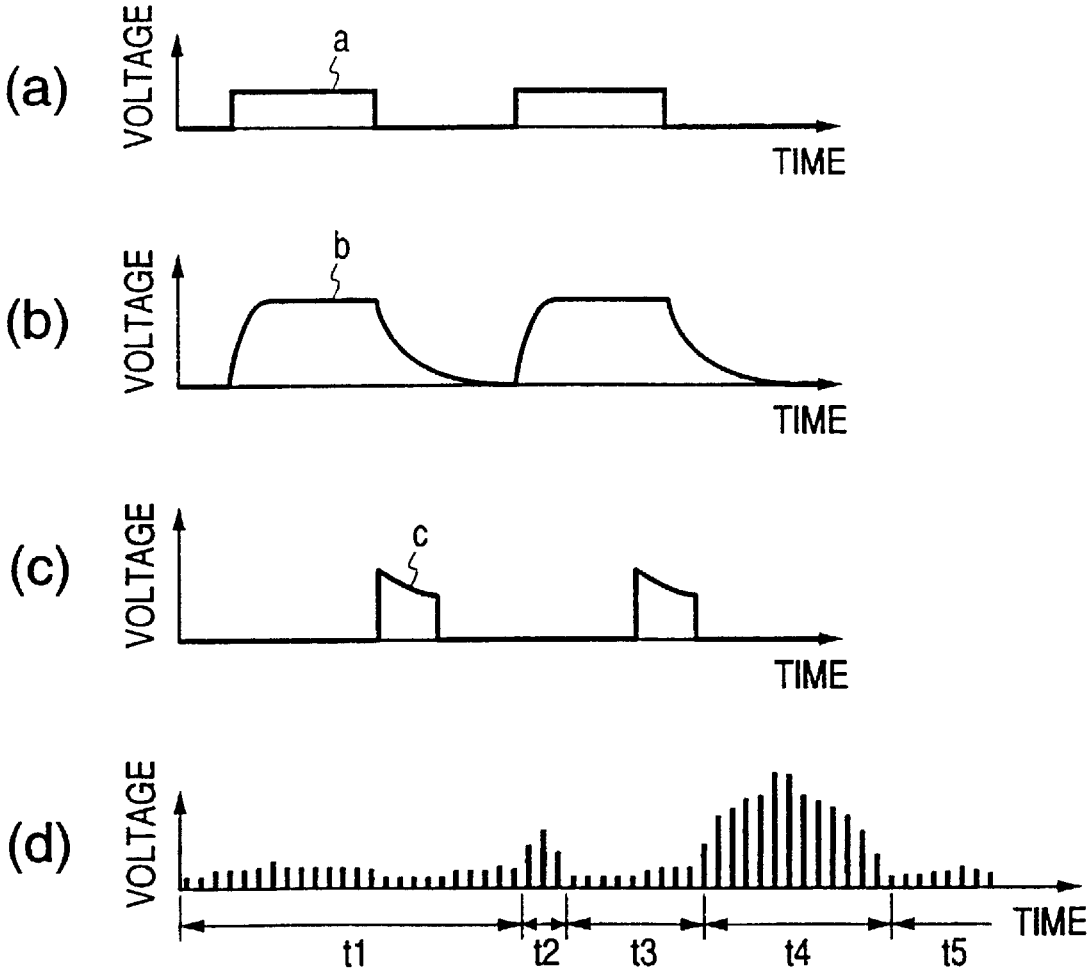
FIGS. 3A to 3D show waveforms illustrating the operation of the vehicle detection system of the embodiment.

FIG. 3A shows the waveform of the control signal a supplied from the calculation unit 21, FIG. 3B shows a charged voltage waveform of the capacitor 34, and FIG. 3C shows the timing and amplitude of the carrier generated by the coil 31 and capacitor 32.

An output from the loop coil 1 received the FSK modulated wave transmitted from the transponder 30 is input via the limiter L and capacitor 18 to the amplifier 19. An amplified output of the amplifier 19 is supplied to the demodulator 20 to demodulate it. The demodulated output of the demodulator 20 is supplied to the calculation unit 20 which processes the demodulation output such as an error correction process and a decoding process to judge whether the discrimination information indicates that the vehicle is a monthly contract vehicle or a parking area associated vehicle. If the vehicle is a monthly contract vehicle or a parking area associated vehicle, a discrimination signal to such effect is sent from the vehicle detection circuit 10 to the controller 60, to thus detect that the monthly contract vehicle or parking area associated vehicle is incoming. Upon reception of the discrimination signal, the controller 60 inhibits the ticket vendor to issue a parking ticket, and drives the gate driver to open the car gate.

If the vehicle A is in the predetermined area and is still not over the loop coil 1, the inductance of the loop coil 1 is higher than that when the vehicle comes over the loop coil 1. In this case, the vehicle detection circuit 40 does not detect that a vehicle is incoming, and does not send a vehicle detection signal to the controller as will be described hereinunder.

Next, as the vehicle A moves further and comes over the loop coil 1, the inductance of the loop coil 1 lowers. An amplified output of the power amplifier 14 is applied to the serial resonance circuit of the loop coil 1 and capacitor 15. The serial resonance circuit of the loop coil 1 and capacitor 15 resonates at a resonance frequency fr1 higher than a resonance frequency fr2, e.g., about 100 kHz when the inductance of the loop coil 1 is not lowered. Therefore, current corresponding to the resonance frequency fr1 shown at a curve al in FIG. 4A flows, the phase of the current being indicated by a curve b1 in FIG. 4B.

In this state, in the vehicle detection circuit 40, magnetic fluxes generated by the loop coil 1 applied with the amplified output of the power amplifier 14 link with the coil 50 so that an electromotive force is induced in the coil 50. A signal made suitable for the phase comparison by the capacitor 41 is supplied to the comparator 42 which compares it with an output of the frequency demultiplier 12. A phase comparison output from the phase comparator 42 is supplied to the integrator 43 which integrates it. An integrated output is A/D converted and supplied to the controller 60. The A/D converted output is checked during the high potential period of the control signal a (the stimulating period for the loop coil 1 or the activating period for the transponder 30) supplied to the controller 60. In this case, the controller 60 judges that the A/D converted output coincides with the data corresponding to a predetermined level, and detects that the vehicle A is over the loop coil 1. This vehicle detection by the vehicle detection circuit 40 is always performed irrespective of whether or not a vehicle is mounted with a transponder 30.

If the vehicle A is mounted with the transponder 30, the vehicle A was already judged as a parking area associated vehicle or a monthly contract vehicle when the vehicle A entered the predetermined area around the loop coil 1 and a presence of the vehicle was already detected. Therefore, irrespective of the detection of the vehicle A by the vehicle detection circuit 40, the ticket vendor does not issue a parking ticked and the car gate is opened to allow the vehicle to run into the parking area.

During the low potential period of the control signal a (the non-stimulating period for loop coil 1 or the transmitting period for transponder 30), the FSK modulated wave is transmitted from the coil 31. In this case, however, the coil 50 is not affected by the FSK modulated wave, because the number of turns of the coil is smaller than that of the loop coil 1 and a magnetic coupling coefficient between the loop coil 1 and coil 50 is small. Since a power induced in the coil 50 is small from the same reason as above, the vehicle detection circuit 40 is not necessary to have a limiter even if a high voltage is induced in the loop coil 1.

If the vehicle A is not mounted with a transponder 30, when the vehicle entered the predetermined area around the loop coil, the discrimination of the vehicle A by a transponder 30 was not made and a presence of the vehicle was not detected. Only when the vehicle comes over the loop coil 1, the vehicle is detected and it is judged that the vehicle is a time charging vehicle. Therefore, when the vehicle detection circuit 40 detects the vehicle A, the ticket vendor issues a parking ticket and when the ticket is picked up, the car gate is opened to allow the car run into the parking area.

If the vehicle A is not mounted with a transponder 30, magnetic fluxes generated by current flowing in the loop coil 1 link only with the coil 50. Therefore, the demodulator 20 outputs no signal and the calculation unit 21 does not send the discrimination signal indicating that the vehicle is a monthly contract vehicle or a parking area associated vehicle. Since the discrimination signal is not sent from the vehicle detection circuit 10 to the controller 60, the controller 60 judges that the vehicle is neither a monthly contract vehicle nor a parking area associated vehicle. Therefore, the controller 60 does not inhibit the ticket vendor to issue a parking ticket, to thereby allow to issue a parking ticket.

Next, a case will be described wherein the vehicle does not come over the loop coil. If the vehicle does not come over the loop coil, the inductance of the loop coil 1 is larger than that when the vehicle comes over the loop coil 1. Therefore, the serial resonance circuit of the loop coil 1 and capacitor 15 applied with the amplified output of the power amplifier 14 resonates at the resonance frequency fr2 when the inductance of the loop coil 1 is not lowered. Therefore, current corresponding to the resonance frequency fr2 shown at a curve a2 in FIG. 4A flows, the phase of the current being indicated by a curve b2 in FIG. 4B.

In this state, in the vehicle detection circuit 40, magnetic fluxes generated by the loop coil 1 applied with the amplified output of the power amplifier 14 link with the coil 50 so that an electromotive force is induced in the coil 50. A signal made suitable for the phase comparison by the capacitor 41 is supplied to the comparator 42 which compares it with an output of the frequency demultiplier 12. A phase comparison output from the phase comparator 42 is supplied to the integrator 43 which integrates it. An integrated output is A/D converted and supplied to the controller 60. The A/D converted output is checked during the high potential period of the control signal a supplied to the controller 60. In this case, the controller 60 judges that the A/D converted output coincides with a level lower than a level of data corresponding to a predetermined level, and detects that the vehicle A does not come over the loop coil 1. Therefore, neither the ticket vendor nor the car gate driver is driven, and neither a parking ticket is issued nor the car gate is opened.

Even if the vehicle A mounted with the transponder 30 enters the predetermined range around the loop coil 1, the vehicle detection circuit 40 operates in the manner same as the above operation to be performed if the vehicle does not come over the loop coil, until the vehicle comes over the loop coil.

Next, how the controller 60 judges that a vehicle is incoming, will be described more specifically. A temperature drift of the resonance frequency of the resonance circuit constituted of the loop coil 1 and the capacitor 15 in the vehicle detection circuit 10 can be lowered by properly setting the capacitor 15, so that a variation of an output level of the phase comparator 42 to be caused by a temperature change can be suppressed. The inductance of the loop coil 1 changes greater when a vehicle comes over the loop coil 1 than when a bicycle not charged comes over the loop coil 1. Therefore, a judgement of an incoming vehicle may be made in accordance with only a level change in an output of the A/D converter 44. Since the controller 60 generally utilizes a microcomputer, a judgement of an incoming vehicle can be made more easier in accordance with a level change pattern of an output of the A/D converter.

With such a judgement using a level change pattern, the temperature compensation of the resonance circuit by properly setting the capacitor 15 is not necessary so that the conditions of design and installation of the vehicle detection system can be alleviated. FIG. 3D is a schematic diagram showing an example of a level change pattern of an output of the A/D converter 44. A period while a voltage indicated by a bar in FIG. 3D is generated corresponds to the high potential period of the control signal a shown in FIG. 3A. A period while a voltage is not generated corresponds to the low potential period of the control signal a shown in FIG. 3A. Periods t1, t3 and t5 correspond to the periods while the inductance of the loop coil 1 gradually changes because of a temperature change and an output of the integrator 43 drifts. A period t2 corresponds to the period while the integrator 43 slightly increases its output level because a bicycle or the like passes over the loop coil 1. A period t4 corresponds to the period while the integrator 3 considerably increases its output level because a vehicle passes over the loop coil 1. In accordance with a change amount and characteristics, e.g., differential characteristics, of such output levels, the controller 60 can detect an output level change pattern of the A/D converter 44. By comparing the detected pattern with patterns stored in advance, the controller can judge that a vehicle comes over the loop coil. In this manner, a vehicle can be detected more stably and with less erroneous detections.

Figure 5:
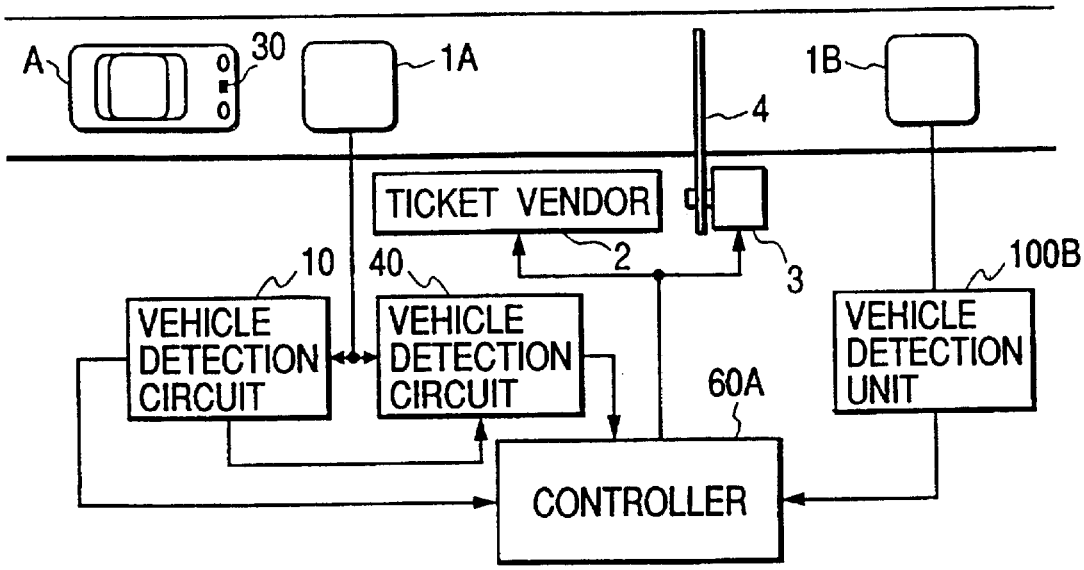
FIG. 5 is a schematic diagram illustrating a parking area management system using the vehicle detection system of the embodiment.

An example of a parking area management system incorporating the vehicle detection system of the embodiment of the invention will be described with reference to FIG. 5.

A loop coil 1A is buried under a vehicle inlet road of a parking area, and another loop coil 1B is buried under a parking area road at the downstream side of a car gate 4. The loop coil 1A is connected substantially to vehicle detection circuits 10 and 40. A discrimination signal from the vehicle detection circuit 10 and a detection signal from the vehicle detection circuit 40 are supplied to a controller 60A. In accordance with an output from the controller 60A, a ticket vendor 2 and a car gate driver 3 are controlled. When a vehicle comes over the loop coil 1A, an output of the controller 60A controls the drive of the ticket vendor 2 in accordance with whether the vehicle 60A is mounted with a transponder 30, and controls the car gate driver 3 irrespective of whether the vehicle 60A is mounted with a transponder 30. More specifically, if the vehicle A is mounted with the transponder 30, the ticket vendor 2 is inhibited to issue a parking ticket and the car gate driver 3 is driven to open the car gate 4, whereas the vehicle A is not mounted with the transponder 30, the ticket vendor 2 is driven to issue a parking ticket, and after the ticket is picked up by the driver, the car gate driver 3 is driven to open the car gate 4.

If the vehicle A does not come over the loop coil 1A, the discrimination signal of the vehicle detection circuit 10 and the detection signal of the vehicle detection circuit 40 are not sent so that the controller 60A does not drive the ticket vendor 2 and car gate drive 3 to remain the car gate 4 closed.

The loop coil 1B is positioned sufficiently spaced apart from the loop coil 1A to the degree that any interference problem does no occur between the loop coils 1A and 1B. Therefore, a conventional vehicle detection unit 100B may be used for the loop coil 1B. When a vehicle comes over the loop coil 1B, the vehicle is detected with the vehicle detection unit 100B and the car gate is closed by the car gate driver 3 under the control of the controller 60A.

In the above example, a passage of a vehicle through the car gate 4 is detected by using the loop coil 1B and the conventional vehicle detection unit 100B. Instead, the configuration same as the loop coil 1A and vehicle detection circuits 10 and 40 may also be used. The vehicle detection circuit 10 operates in response to the control signal a shown in FIG. 3A. Therefore, even if a plurality of vehicle detection circuits 10 with loop coils 1A are used at positions near to each other, interference can be prevented through proper synchronization between control signals a. Therefore, if another vehicle detection circuit 10 is connected to the loop coil 1B in place of the vehicle detection unit 100B and proper synchronization is established between the control signals a for the vehicle detection circuits connected to the loop coil 1A and 1B, then stable operation is ensured even if the loop coils 1A and 1B are positioned in an area with possible interference.

Figure 6:
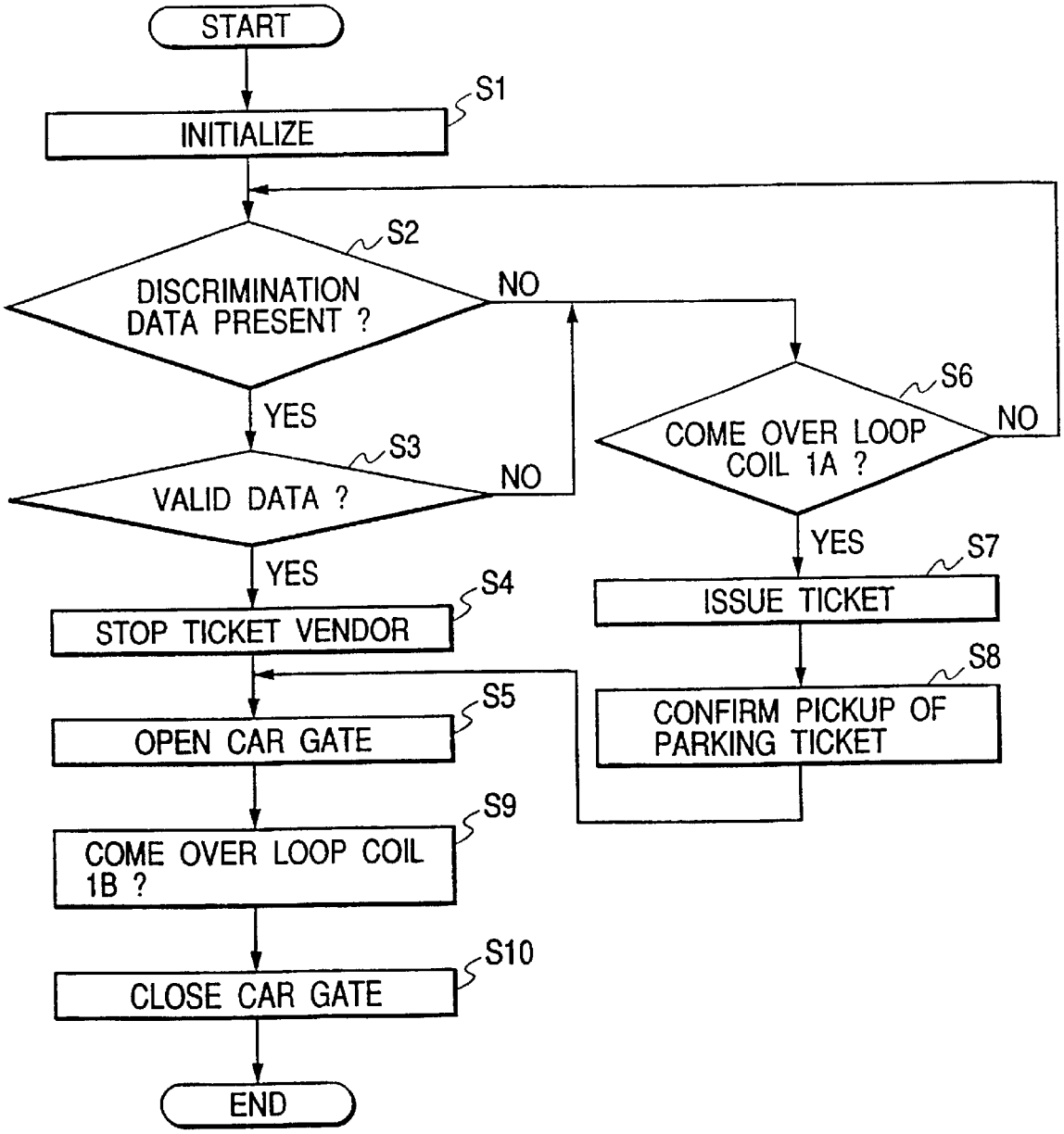
FIG. 6 is a flow chart illustrating the operation of the parking area management system using the vehicle detection system of the embodiment.

The operation of the parking area management system shown in FIG. 5 will be described with reference to the flow chart shown in FIG. 6.

At the start of a business hour of the parking area, the controller 60A is initialized (Step S1) to wait for an incoming vehicle. Next, it is checked whether there is discrimination data obtained through magnetic coupling with a transponder 30 of an incoming vehicle A (Step S2). If the vehicle A is not mounted with the transponder 30, it is judged at Step S2 that there is no discrimination data, and thereafter it is checked whether a vehicle A comes over the loop coil 1A (Step S6).

If the vehicle A is mounted with the transponder 30 at Step S2, it is judged whether the discrimination data is valid or not (Step S3). If it is judged at Step S3 that the discrimination data is valid, the flow follows Step S6 after Step S3. The judgement at Step S3 that the discrimination data is not valid, means obviously that the vehicle A is not a parking area associated vehicle nor a monthly contract vehicle, and also that, for example, the discrimination data indicated an expiration of an effective term.

If it is judged as valid data at Step S3, the ticket vendor 2 is inhibited to issue a parking ticket (Step S4), and then the car gate 3 is opened (Step S5).

If it is judged at Step S6 that a vehicle comes over the loop coil 1A, the ticket vendor 2 issues a parking ticket (Step S7). It is then checked whether the parking ticked is picked up (Step S8). If it is confirmed that the parking ticked was picked up, the car gate 3 is opened at Step S5.

After the car gate 3 is opened at Step S5, it is checked whether the vehicle A passes through the car gate 3 and comes over the loop coil 1B (Step S9). If the vehicle A comes over the loop coil 1B, the car gate 3 is closed (Step S10) and the vehicle A parks in the parking area. In the above example, the description is directed to the inlet side of the parking area. Similar operations are performed also on the outlet side of the parking area, excepting that a parking account adjuster is installed in place of the ticket vendor 2, and the car gate 3 is opened after the parking account adjustment.

Next, a modification of the vehicle detection system according to the embodiment of the invention will be described.

Figure 7:
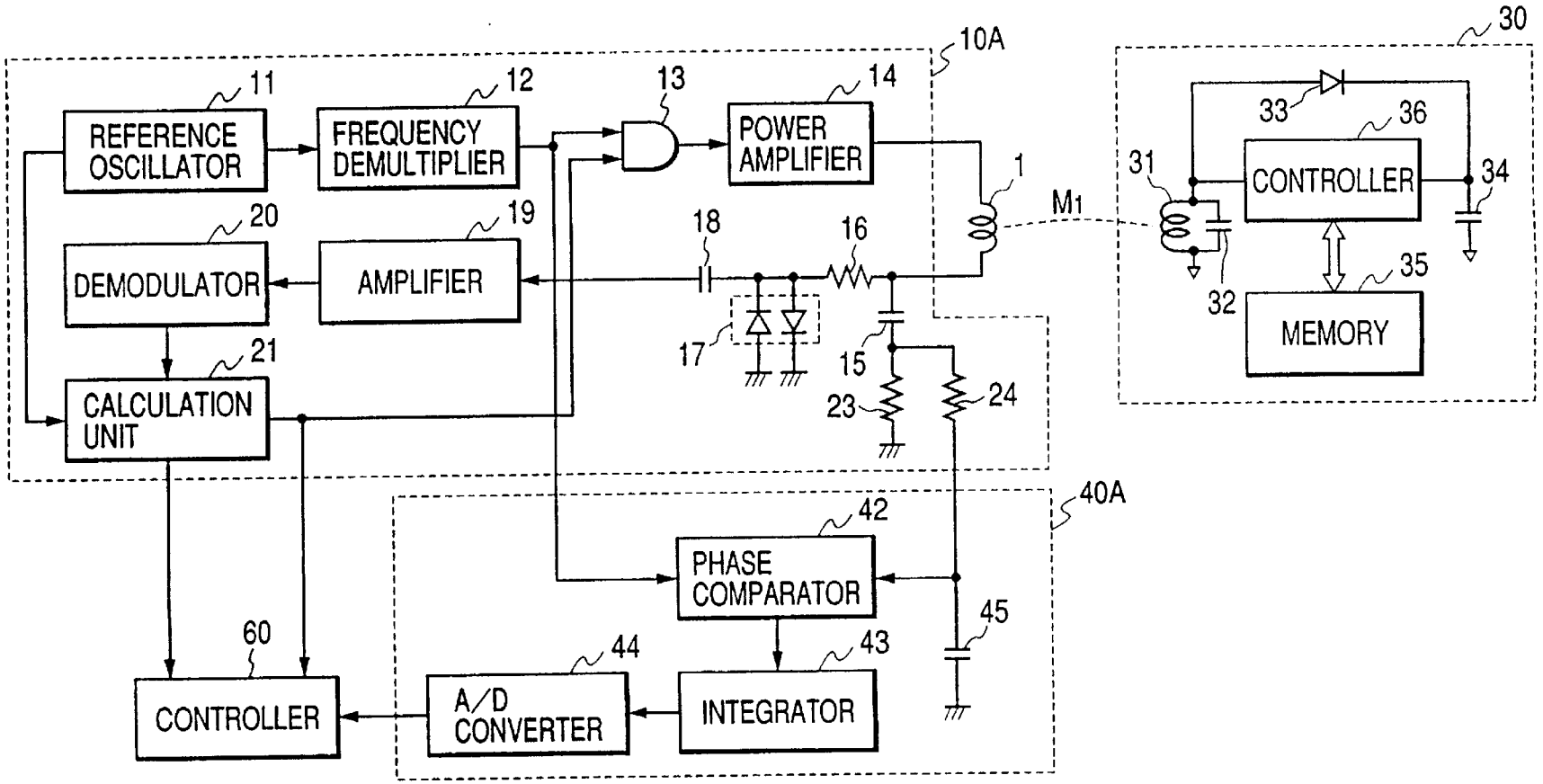
FIG. 7 is a block diagram showing the structure of a vehicle detection system according to a modification of the embodiment.

FIG. 7 is a block diagram showing the configuration of the modification of the vehicle detection system according to the embodiment of the invention. A vehicle detection circuit 10A is used in place of the vehicle detection circuit 10, and another vehicle detection circuit 40A is used in place of the vehicle detection circuit 40.

In the vehicle detection circuit 10 of the above embodiment, large current flowing through the loop coil 1 during the high potential period of the control signal a is detected with the coil 50. In contrast, in this modification, the current flowing in the loop coil 1 is detected by a resistor 23 which is inserted between a capacitor 15 and the ground and has a small resistance value not considerably affecting Q of the serial resonance circuit of the loop coil 1 and capacitor 15. The voltage across the resistor 23 is supplied via a resistor 24 to the vehicle detection circuit 40A.

In the vehicle detection circuit 40A, a voltage detected by the resistor 23 replacing the coil 50 of the above embodiment is applied to a capacitor 45 to charge it, and the charged voltage across the capacitor 45 is supplied to a phase comparator. In this modification, therefore, the coil 50 and capacitor 41 of the above embodiment are omitted. The resistor 24 and capacitor 45 are properly selected so that the phase comparator 42 can perform an optimum phase comparison with the voltage phase generated by the loop coil 1. The other structures of the vehicle detection circuits 10A and 40A are the same as those of the vehicle detection circuits 10 and 40, and the vehicle detection circuits 10A and 40A realize equivalent operations to those of the vehicle detection circuits 10 and 40.

Next, another modification of the vehicle detection system according to the embodiment of the invention will be described.

Figure 8:
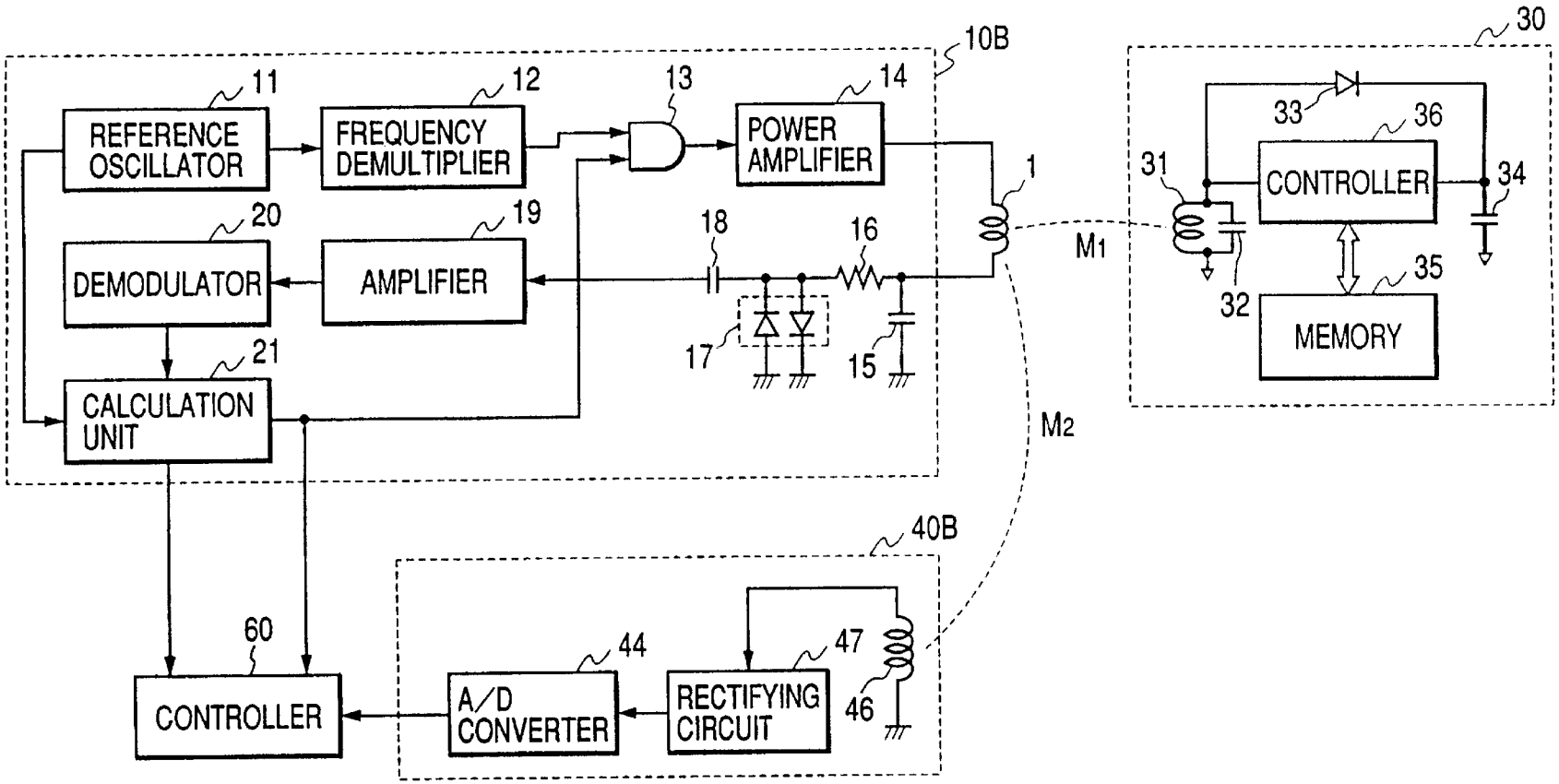
FIG. 8 is a block diagram showing the structure of a vehicle detection system according to another modification of the embodiment.
Figure 9:
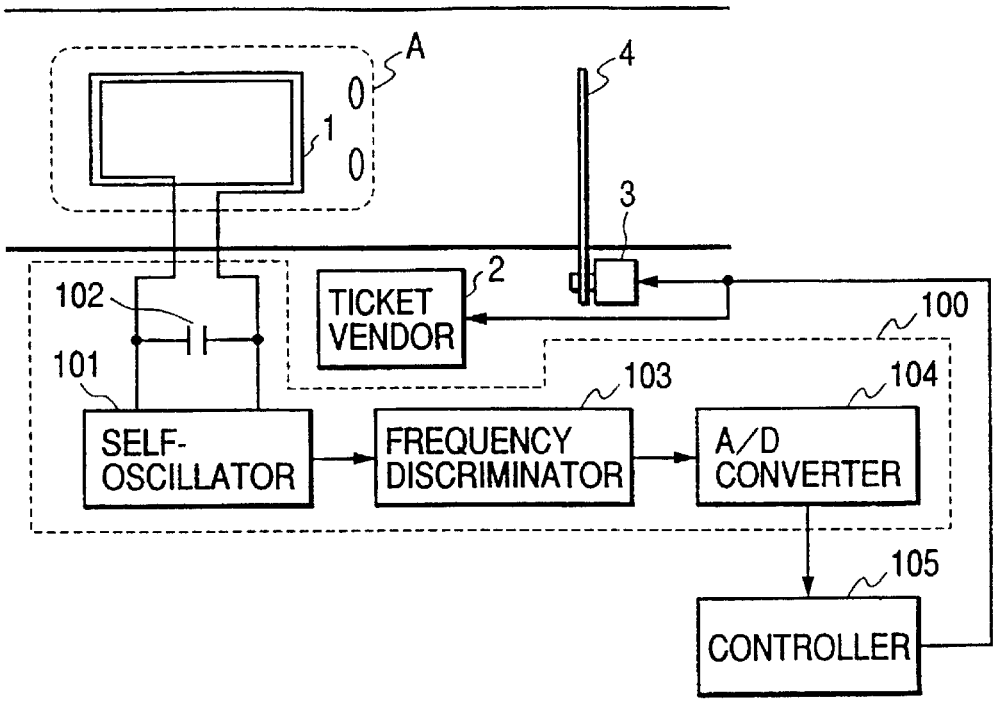
FIG. 9 is a block diagram showing the structure of a conventional vehicle detection system.
Figure 10:
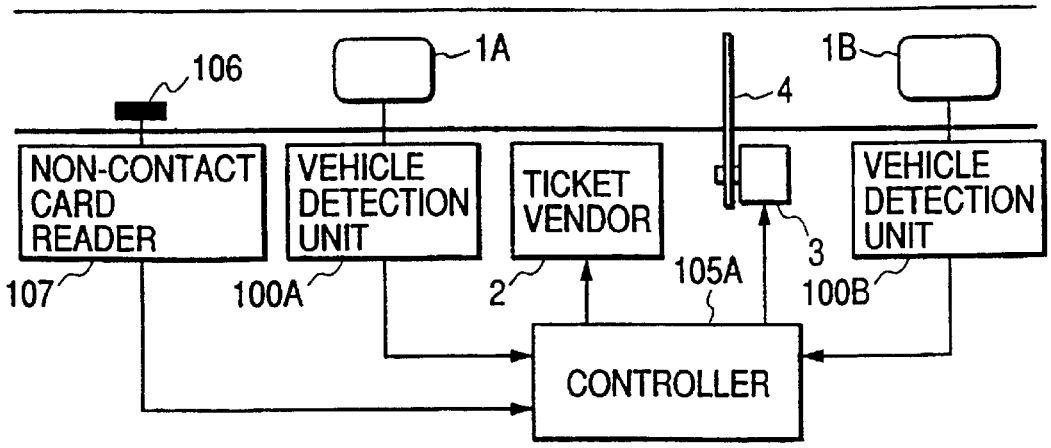
FIG. 10 is a schematic diagram illustrating a parking area management system using the conventional vehicle detection system.

FIG. 8 is a block diagram showing the configuration of the other modification of the vehicle detection system according to the embodiment of the invention. In this modification, a vehicle detection circuit 40B is used in place of the vehicle detection circuit 40. The vehicle detection circuit 40B detects a presence of a vehicle in accordance with a rectified output level of voltage induced in a coil 46, without using an output of a frequency demultiplier 12 of a vehicle detection circuit 10B replacing the vehicle detection circuit 10.

Figure 4:
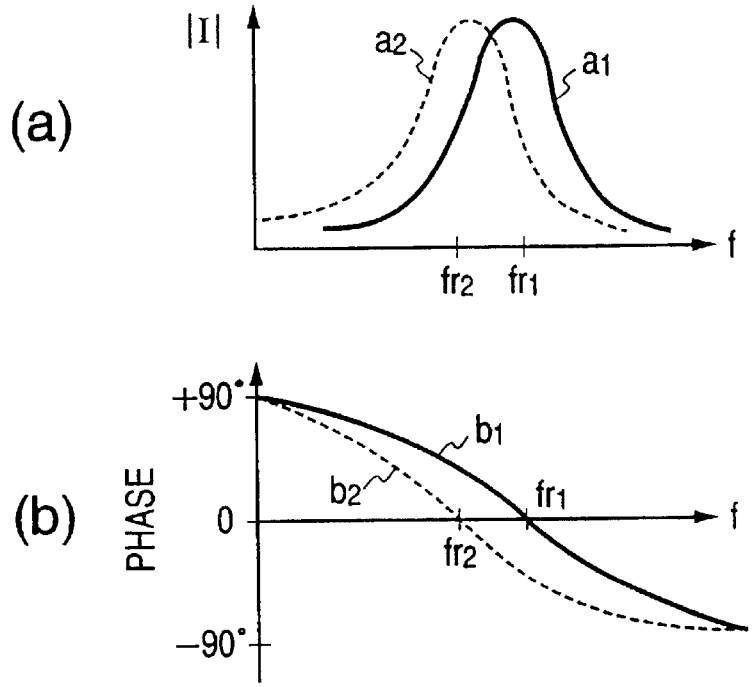
FIGS. 4A and 4B are diagrams illustrating the operation of the vehicle detection system of the embodiment.

The values of current flowing in the loop coil 1 when a vehicle is and is not over the loop coil 1 are determined from the curves a1 and a2 shown in FIG. 4A. The curve a2 corresponds to when a vehicle is over the loop coil 1, and the curve al corresponds to when a vehicle is not over the loop coil 1. The current flowing in the loop coil 1 induces a voltage across the coil 46 through magnetic coupling M2. This voltage changes with the current flowing in the coil 1. Therefore, a presence of a vehicle can be detected by monitoring this voltage. In this other modification, the voltage induced across the coil 46 is rectified by a rectifying circuit 47 and the rectified output voltage is A/D converted to make the controller 60 detect a presence of a vehicle. The rectifying circuit 47 may be omitted if the voltage induced on the coil 46 is directly A/D converted.

As described so far, according to the vehicle detection system of this invention, by using an inexpensive transponder, it is possible to discriminately detect between the parking area associated vehicles and monthly contract vehicles, and the time changing vehicles.

We claim:

1. A vehicle detection system for detecting an arrival of a predetermined vehicle provided with a transponder and a vehicle without the transponder comprising;

a first inductive element of a loop coil disposed at a parking car road for functioning as transmitting and receiving means, a first vehicle detection circuit connected to the inductive element, wherein said transponder mounted on the predetermined vehicle stores information which identifies the predetermined vehicle, periodically activated by the magnetic field which first inductive element generates, periodically transmits the stored information to the vehicle detecting circuit via the first inductive element, characterized in that the vehicle detecting circuit intermittently stimulated the inductive element to generate the magnetic field, the vehicle detecting circuit receives the stored information from the transponder during a non-stimulating period for the first inductive element to identify the predetermined vehicle when the transponder mounted vehicle has entered into a specified area around the first inductive element, and the vehicle detecting circuit detects the arrival of a vehicle by detecting a phase change between the magnetic field during non-existence of the vehicle around the first inductive element and the magnetic field during an existence of the vehicle around the first inductive element, the phase change being caused by a change of inductance in the first inductive element.

2. A vehicle detection system according to claim 1, wherein the vehicle detecting circuit is provided with a second inductive element magnetically coupling with the first inductive element, wherein the vehicle detecting circuit detects whether a vehicle exists around the first inductive element by examining the phase difference between the induced magnetic field in the second inductive element and the first inductive element activation signal.

3. A vehicle detection system according to claim 2, wherein a second vehicle detecting circuit comprises a phase comparator for comparing the phase of the signal induced in a second inductive element with the phase of the output signal from the frequency divider, the second inductive element having the small number of turns and located adjacent to the first inductive element thereby magnetically coupling with the first inductive element, an integrator for integrating the phase comparison output from the phase comparator, and an A/D converter for A/D-converting the output of the integrator to transmit the A/D-converted vehicle detecting signal to the control unit.

4. A vehicle detection system according to claim 3, wherein the control unit detects the changing pattern of output voltage level and compares the detected pattern with the pattern stored in advance thereby the second vehicle detecting circuit may detect the arrival of a vehicle near the first inductive element.

5. A vehicle detection system according to claim 1, wherein the vehicle detecting circuit further comprises a capacitor serially connected to the first inductive element to constitute a serial resonance circuit with the first inductive element.

6. A vehicle detection system according to claim 1, using the FSK modulation wave to transmit the information from the transponder.

7. A vehicle detection system according to claim 1 wherein the vehicle detecting circuit includes a circuit for comparing the phase of the magnetic field in the first inductive element with a phase of the first inductive element activation signal.

8. A vehicle parking gate system comprising the vehicle detection system as defined by claim 1, ticket vendor, car gate and controller wherein the controller controls the ticket vendor and the car gate so that the car gate is opened without issuing a ticket by the ticket vendor when the vehicle detection system has identified the predetermined vehicle and the car gate is opened after issuing the ticket by the ticket vendor when the vehicle detection has not identified the predetermined vehicle but has detected the existence of the vehicle around the first inductive element.

* * * * *